US006763817B2

(12) United States Patent
Nickell

(10) Patent No.: US 6,763,817 B2
(45) Date of Patent: Jul. 20, 2004

(54) CROSSBOW ARROW PROTECTIVE SHIELD

(76) Inventor: Michael A. Nickell, 3633 O'Donnell Ct., Columbus, OH (US) 43228

( * ) Notice: Subject to any disclaimer, the term of this patent is extended or adjusted under 35 U.S.C. 154(b) by 0 days.

(21) Appl. No.: 10/075,127

(22) Filed: May 13, 2002

(65) Prior Publication Data

US 2003/0209237 A1 Nov. 13, 2003

(51) Int. Cl.[7] ..... F41B 5/12
(52) U.S. Cl. ..... 124/25; 124/25.5
(58) Field of Search ..... 124/25, 25.5, 25.7, 124/86; 224/916

(56) References Cited

U.S. PATENT DOCUMENTS 1,192,639 A * 7/1916 Hunholz
2,746,658 A * 5/1956 Freid
3,483,857 A * 12/1969 Jones
4,827,893 A * 5/1989 Nishioka
4,947,822 A * 8/1990 Jones et al.
5,062,406 A * 11/1991 Robertson ..... 124/25
5,678,528 A * 10/1997 Hadley ..... 124/25
5,775,313 A * 7/1998 Bresette et al. ..... 124/86

* cited by examiner

*Primary Examiner*—John A. Ricci
(74) *Attorney, Agent, or Firm*—David A. Greenlee

(57) ABSTRACT

A crossbow having an open-top track mounts a protective shield for a loaded arrow. The shield is an upwardly convex elongated cover of sufficient length to substantially overlie the portions of a loaded arrow which are not already covered. The cover has a flat portion that mounts to a bracket on the crossbow. The cover shape spaces the shield from the loaded arrow so as to not affect the flight of the arrow when fired and extends sufficiently forward to cover and protect the tip of the loaded arrow from engagement by external objects to prevent inadvertent dislodgement of the arrow from its loaded position. The cover mounts a quiver atop the cover for storing spare arrows.

10 Claims, 3 Drawing Sheets

CROSSBOW ARROW PROTECTIVE SHIELD

RELATED APPLICATION

Applicant claims priority to U.S. Provisional Application No. 60/266,125, filed Feb. 2, 2001.

TECHNICAL FIELD

This invention relates to crossbows and, more particularly, to a device for protecting an arrow loaded into firing position in a crossbow.

BACKGROUND OF THE INVENTION

Crossbows are enjoying a resurgence of popularity among hunters. Most states set aside a portion of deer and other animal hunting season for exclusive use by bow hunters who mostly employ crosshows. Also, the effective range of a crossbow is much less than a conventional hunting rifle, thus making this type of hunting more challenging and rewarding to the true hunter. This exclusivity and challenge have elevated the popularity of the crossbow.

Crossbows have developed from wood and metal devices to be largely made of fiberglass and other plastic materials, which make a crossbow more durable, lighter and stronger. Crossbows are frequently fitted with scopes.

Since hunting is normally confined to late fall months in the northern states, hunters must hunt in all types of weather, including cold, rain, sleet and snow. Hunting also requires the hunter to traverse all types of terrain, including mainly underbrush of varying density. When stalking a deer, a hunter generally positions himself in dense brush near a deer trail and waits for a deer to appear. During this time, rain, sleet or snow are commonly encountered. Also, the loaded crossbow will normally be surrounded by brush and brambles, which can engage and foul a loaded arrow and prevent accurate firing.

Many forms of quivers for holding a supply of arrows have been devised. The usual quiver mounts on the hunter's body, although bow-mounted quivers are currently marketed. These bow-mounted quivers mount the arrows beneath the bow in a lateral position, which invites fouling by brush normally engaged during hunting. Quivers are also available which mount the arrows longitudinally beneath the crossbow. This mount also invites fouling by brush due to its location, and interferes with the ease of gripping the bow barrel when aiming and shooting.

It would be desirable to provide a means to protect a loaded arrow in a crossbow from the elements, and prevent dislodgement by brush.

It would also be desirable to provide a bow-mounted quiver to hold a supply of arrows in a more convenient and protected position.

SUMMARY OF THE INVENTION

It is an object of this invention to provide a means to protect a loaded arrow in a crossbow from the elements, and prevent dislodgement by brush.

It is another object to provide a quiver mounted on the protective shield to hold a supply of arrows in a more convenient and protected position.

According to this invention, a crossbow having an open-top track that receives a arrow for engagement by a bow-string when loaded and cocked for firing, and guides the arrow's flight when fired, mounts a protective shield which comprises a upwardly convex elongated cover of sufficient length to substantially overlie the portions of a loaded arrow which are not already covered. The cover has a flat portion that includes means for mounting to a bracket carried by the crossbow. The cover shape and mounting position effectively space the shield from the loaded arrow so as to not affect the flight of the arrow when fired. The cover extends sufficiently forward to cover and protect the tip of the loaded arrow from engagement by external objects to prevent inadvertent dislodgement of the arrow from its loaded position.

In one embodiment, the cover has a generally curvilinear cross-section and is mounted to create a lateral vertical space between the cover and the crossbow sufficient to enable movement of the bowstring to cock and fire the arrow, and includes an extended outward flare along one side which enables an arrow to be loaded into firing position between the shield and the crossbow.

In one form of a preferred embodiment, the cover mounts a quiver atop the cover. The quiver comprises a forward pocket having a foam pad for receiving the arrow tips, a rearward holder having notches receiving the arrow shafts in spaced relation, and a mounting bracket which mounts the pocket and holder on the cover. In this way, the arrows are mounted longitudinally of the bow, with the tips forward and shrouded for protection, in a position making them readily available for reloading.

In another form of the preferred embodiment, the quiver is mounted beneath the cover.

DESCRIPTION OF THE PREFERRED EMBODIMENT

Figure 1:
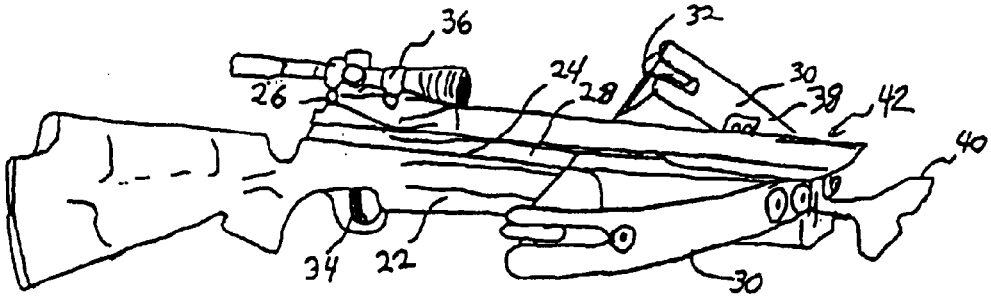
FIG. 1 is a side perspective view of one embodiment of a crossbow protective shield according to this invention.
Figure 2:
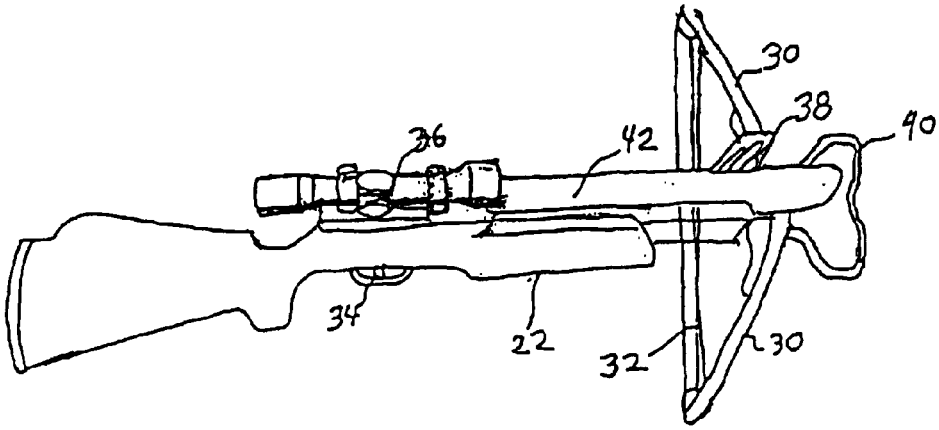
FIG. 2 is top quarter perspective view of the crossbow protective shield of FIG. 1.
Figure 3:
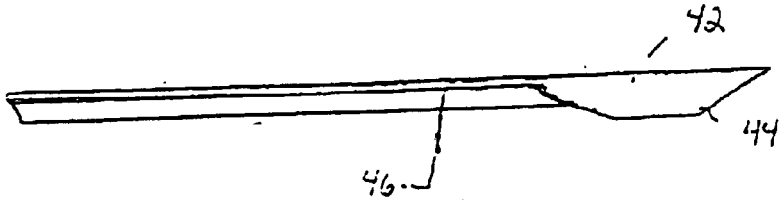
FIGS. 3, 4 and 5 are side, end and top views of the cover portion of the protective shield of FIGS. 1 and 2.
Figure 4:
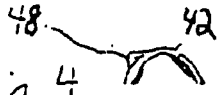
Figure 5:
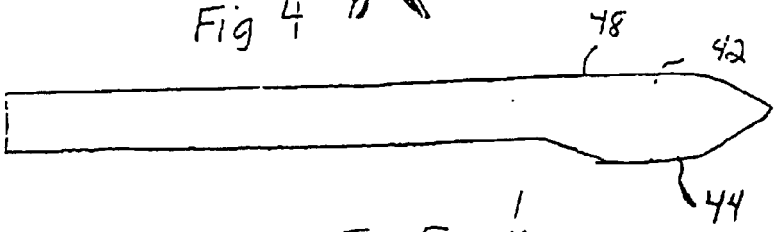

Referring to FIGS. 1 and 2, a crossbow of any conventional construction 20 includes a barrel 22 which mounts a rail 24 and arrow holder 26 for holding an arrow, or arrow 28 (partially illustrated), in a position for shooting, in a conventional manner. Crossbow 20 further includes the usual bow limbs 30, bow string 32, release trigger 34, optional scope 36, accessory bracket 38, and stirrup 40.

When hunting, the hunter normally loads arrow 28 in crossbow 20 in a position ready for firing. In a normal crossbow, the loaded arrow is protected from brush encountered during hunting only by stirrup 40, which protects the front end of crossbow 20 and the tip of arrow 28 from impacting trees or brush. Otherwise, arrow 28 is upwardly unprotected from tree limbs and other brush which could foul the arrow and prevent accurate firing. Arrow 28 is also unprotected from the elements such as snow and ice which could foul the arrow feathers and adversely affect the accuracy of its flight.

To protect the arrow, a protective shield comprising a molded plastic cover 42 is provided. Cover 42 is an elongated, upwardly convex piece of durable plastic that can be painted in camouflage. It includes a forward flange 44 that is cut back at 46 throughout most of the length of cover 42. A forward, vertical, flat portion 48 is provided and drilled appropriately for attachment to the crossbow accessory bracket 38. The drilled holes are patterned to enable mounting on all makes of bows. The rear of cover 42 underlies scope 36 and thus covers substantially the entire length of loaded arrow 28, protecting it from engaging brush and brambles and shielding it from show and rain.

After firing loaded arrow 28, the hunter will want to quickly reload an arrow. The cutout portion 46 enables the replacement arrow to be readily inserted onto rail 24.

Figure 6:
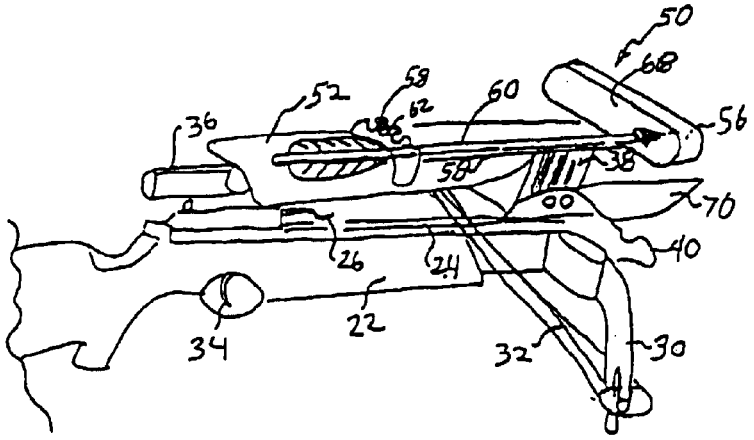
FIG. 6 is a partial side perspective view of one form of a preferred embodiment of crossbow protective shield according to this invention, showing a quiver mounted atop the cover.
Figure 7:
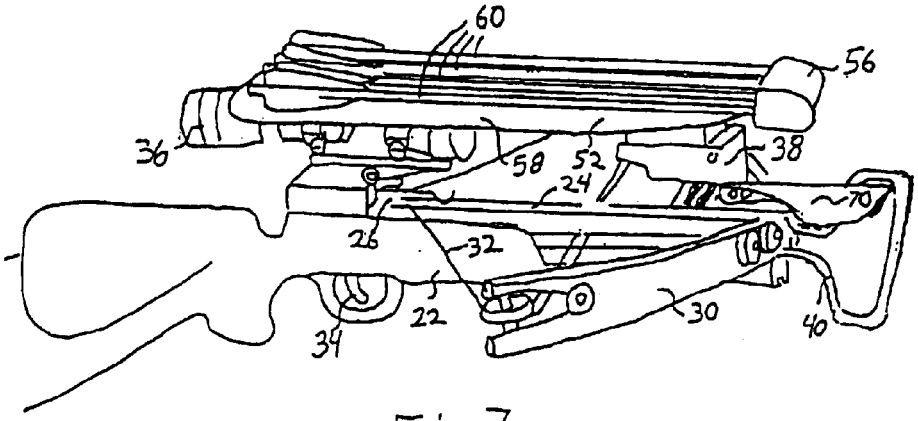
FIG. 7 a view similar to FIG. 6, showing further details of construction.
Figure 9:
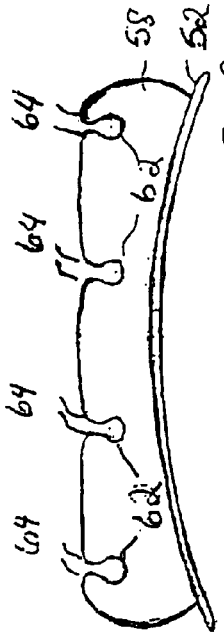
FIG. 9 is a detail view of the arrow shaft holder shown in FIG. 8.
Figure 8:
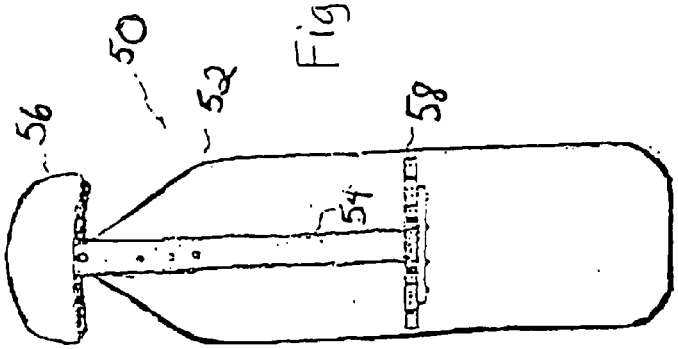
FIG. 8 is a top view of the cover of the shield of FIGS. 6 and 7, showing details of the quiver.
Figure 10:
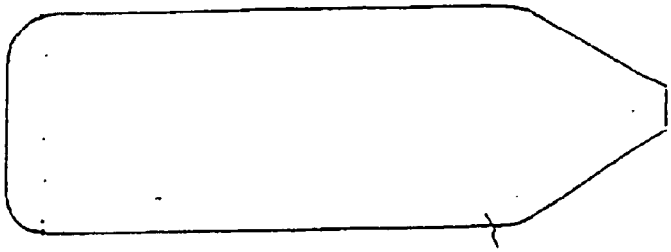
FIG. 10 is a top view of the cover.
Figure 11:
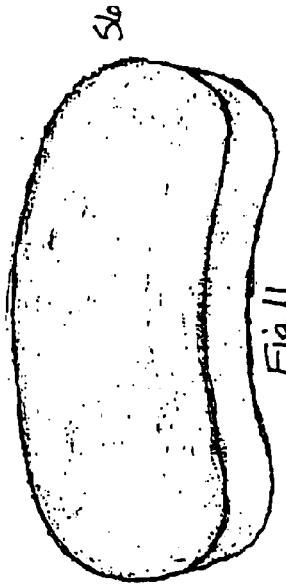
FIGS. 11 and 12 are top and end views of the arrow tip pocket.
Figure 12:
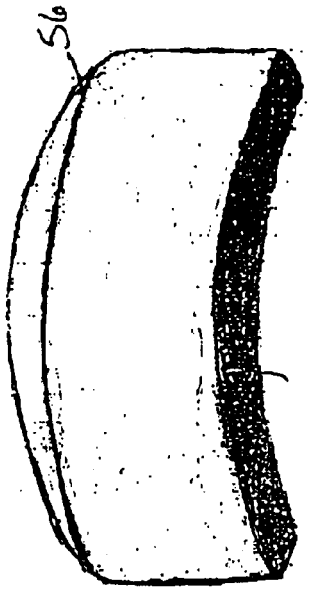

A preferred embodiment of protective shield is shown in FIGS. 6 and 7. Here a quiver 50 is mounted atop an upper cover 52, which is again attached at its forward end to accessory bracket 38. Quiver 50 comprises a mounting bracket 54 a protective pocket 56 and a holder 58. As illustrated, a plurality of arrows 60 is stored in quiver 50 with their shafts held in notches 62 of holder 58. As seen in FIG. 9, the entry slots 64 of notches 62 preferably are lined with soft plastic inserts 66, which enable the shafts of arrows 60 to be easily snapped into and retained in the notches against accidental dislodgement. The shafts are readily manually snapped out of the notches when use of an arrow is desired.

Pocket 56 mounts a pad of sponge rubber 68 or other soft material for receiving the heads of arrows 60 and cooperated with holder 58 to retain them against dislodgement. Both holder 58 and pocket 56 are mounted on mounting bracket 45, which is rivet, screwed or otherwise secured atop cover 52 as illustrated. In this embodiment, a curved lower cover 70 is mounted on accessory bracket 38 and projects forwardly to cover the head and forward end of the arrow 28 that is in firing position on rail 24.

In this embodiment, the mounted arrow is completely covered and protected from engagement with brush and is sheltered from rain, snow and ice, while a ready supply of arrows is at hand for rapid reloading. The mounting of quiver 50 keeps the stored arrows up high and away from brush on the ground as the hunter treks through underbrush. It also provides good balance on the bow.

Figure 15:
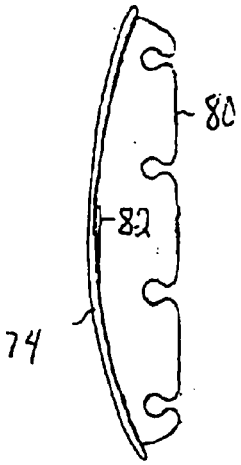
FIG. 15 is a detail view of arrow shaft holder used with the protective shield of FIGS. 13 and 14.
Figure 13:
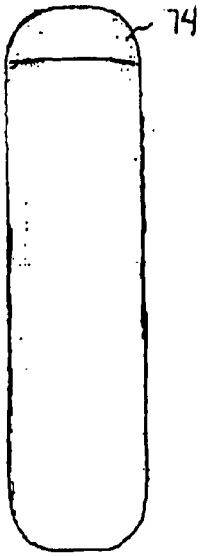
FIGS. 13 and 14 are top and bottom views of another form of a preferred embodiment of crossbow protective shield according to this invention, showing a quiver mounted beneath the cover.
Figure 14:
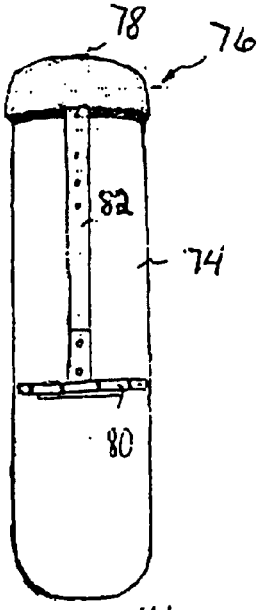

Another form of preferred embodiment is shown in FIGS. 13–15, in which a cover 74 is provided with an undermounted quiver 76. In this embodiment, the protective pocket 78, holder 80 and mounting bracket 82 are mounted beneath upper cover 84. This requires that cover 84 be mounted higher above the crossbow so that the arrows stored in quiver 76 do not interfere with the firing of arrows. The advantage of this embodiment is that the arrows stored in quiver 76 are completely protected from engagement with brush, and are protected from the elements, preventing the buildup of snow or ice on the arrow feathers.

While only several embodiments of this invention have been shown and described, obvious modifications are contemplated and are intended to be covered by the claims.

I claim:

1. A protective shield for protecting an arrow loaded in a crossbow which has an open-top track that receives the arrow for engagement by a bowstring when loaded and cocked for firing, and guides the arrow's flight when fired, said shield comprising an elongated cover of sufficient length to substantially overlie a loaded arrow, means for mounting the shield to a bracket carried by the crossbow, and storing means for storing a plurality of arrows in an orientation longitudinally of the crossbow atop the cover which includes a pocket for receiving the tips of the plurality of stored arrows, the cover shape and mounting position effectively spacing the cover from the loaded arrow so as to not affect the flight of the arrow when fired, the shield effectively protecting the loaded arrow from being fouled by brush and shielding the loaded arrow from the elements.

2. The protective shield of claim 1, wherein the storing means includes a holder is mounted on the cover spaced from the pocket, said holder having notches for receiving the shafts of the plurality of arrows in spaced relation, and the pocket includes a foam pad for receiving the tips of the arrows.

3. The protective shield of claim 2 wherein the holder and pocket are secured atop the cover.

4. The protective cover of claim 2, wherein the holder and pocket are mounted beneath the cover.

5. The protective shield of claim 4, wherein the cover is formed of a plastic material.

6. The protective shield of claim 4, wherein said bracket is an accessory-mounting bracket.

7. The protective shield of claim 1, wherein the crossbow has a scope mounted on it so as to partially cover the rearmost portion of the arrow when loaded, the cover covering the remaining forward portion of the arrow.

8. A protective shield for a crossbow which has an open-top track that receives an arrow for engagement by a bowstring when loaded and cocked for firing, and guides the arrow's flight when fired, said shield comprising an upwardly convex elongated cover of sufficient length to substantially overlie the portions of a loaded arrow which are not already covered, said cover having a flat portion that includes means for mounting to a bracket carried by the crossbow, the cover shape and mounting position effectively spacing the cover from the loaded arrow so as to not affect the flight of the arrow when fired.

9. The protective shield of claim 8, wherein the cover extends sufficiently forward to overlie and protect the tip of the loaded arrow from engagement by external objects to prevent inadvertent dislodgement of the arrow from its loaded position.

10. The protective shield of claim 9, wherein the cover has a generally curvilinear cross-section and is mounted to create a lateral vertical space between the shield and the crossbow sufficient to enable movement of the bowstring to cock and fire the arrow, and includes an extended outward flare at one side to enable an arrow to be loaded into firing position between the shield and the crossbow.

* * * * *